US005641083A

United States Patent [19]

Metcalf

[11] Patent Number: 5,641,083

[45] Date of Patent: Jun. 24, 1997

[54] ADJUSTABLE CANTILEVER SHELVING SYSTEM

[75] Inventor: Derek N. G. Metcalf, LaGrange Park, Ill.

[73] Assignee: Athena Industries, Inc., LaGrange, Ill.

[21] Appl. No.: 425,605

[22] Filed: Apr. 20, 1995

[51] Int. Cl.[6] ..... A47B 43/00; A47B 47/00; A47B 57/00

[52] U.S. Cl. ..... 211/187; 248/243; 108/1

[58] Field of Search ..... 211/187, 181, 211/106, 90, 59.2; 248/242, 245; 108/1, 5, 7

[56] References Cited

U.S. PATENT DOCUMENTS

| | | | |
|---|---|---|---|
| 1,428,730 | 9/1922 | Weston | 108/1 |
| 2,648,442 | 8/1953 | Lowmaster | 248/242 X |
| 3,182,945 | 5/1965 | Sedo | 248/242 |
| 3,280,989 | 10/1966 | Melvin et al. | 211/187 X |
| 3,701,325 | 10/1972 | Fenwick | 108/1 |
| 5,449,076 | 9/1995 | Van Noord | 211/106 X |

*Primary Examiner*—Ramon O. Ramirez
*Assistant Examiner*—Sandra Snapp
*Attorney, Agent, or Firm*—McCaleb, Lucas & Brugman

[57] ABSTRACT

An adjustable cantilever mounted shelf and support assembly is disclosed in which a generally quadrangular planar shelf structure is fitted with a pair of rigid, fixed anchor brackets extending from rear corners of the shelf. Each bracket includes a linear body having a parallel offset upstanding peg at its upper end aligned at an acute angle to the plane of the shelf and a co-planar rearwardly extending peg at its lower end aligned parallel to the plane of the shelf; selected of such pegs being insertible into appropriately spaced openings in corresponding walls of vertical support members to effect mounting the shelf in either horizontal or inclined positions as selected.

7 Claims, 2 Drawing Sheets

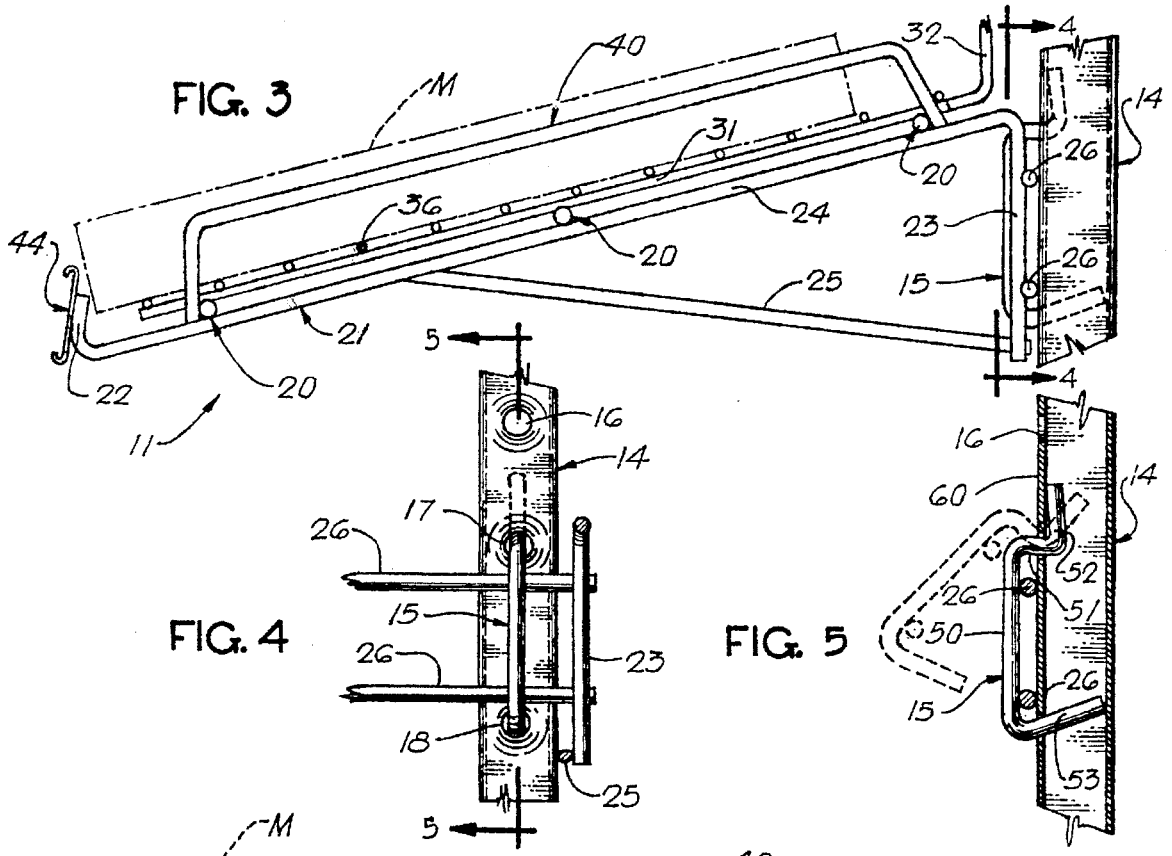
FIG. 3
M
40
32
4
14
31
26
20
36
24
23
44
20
26
25
15
21
5
22
20
4
11
16
14
16
60
14
17
52
26
26
51
15
50
FIG. 4
26
23
FIG. 5
26
18
15
25
53
5
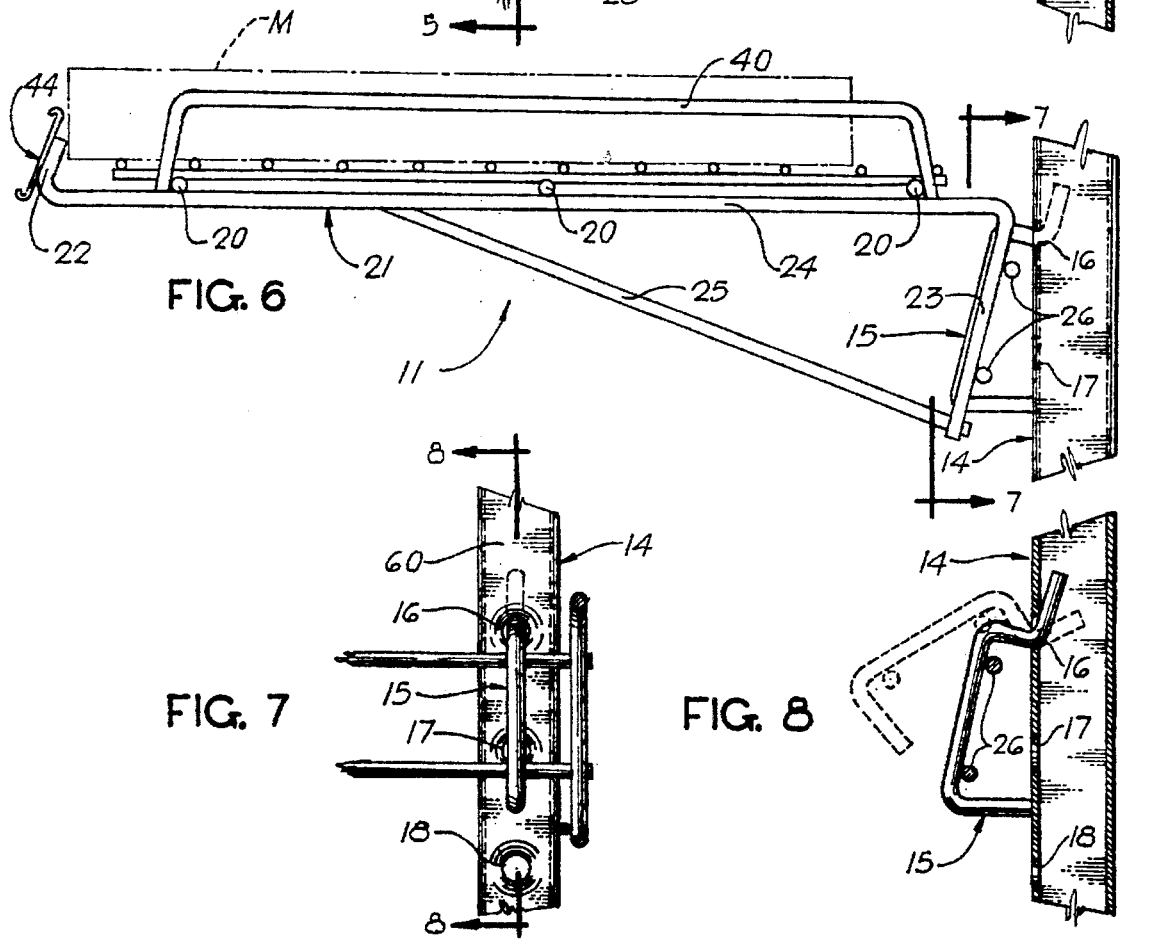
M
40
44
7
22
20
20
20
24
16
21
25
23
26
FIG. 6
15
17
11
14
7
8
14
60
14
16
16
15
17
FIG. 7
FIG. 8
26
17
18
15
18
8

ADJUSTABLE CANTILEVER SHELVING SYSTEM

This invention is directed to cantilever mounted shelving and related support assembly and more particularly to an improved combination of parts operable to mount cantilever shelves in selected horizontal and inclined positions.

Cantilever mounted shelves familiarly are employed in a variety of installations, such as merchandise displays, book shelves, refrigerator shelves and others, to name a few.

In many such installations it is frequently desirable to position the shelves either horizontally or in inclined positions with respect to vertical supporting structures, such as a wall. This is especially true when displaying articles of merchandise. However, most such known support systems are not readily adaptable for supporting the shelves in either a horizontal or inclined attitude at the user's selection. In fact, the more familiar cantilever mounted shelf systems usually are designed to accommodate only one positional attitude of the shelves, either horizontal or inclined. Known adjustable systems for selectively supporting horizontal or inclined cantilevered shelves are relatively complex and cumbersome requiring extensive realignment of the shelf anchoring elements to effect a desired change in shelf attitude. One such adjustable system is described in U.S. Pat. No. 4,492,169, issued Jan. 8, 1985, wherein a system for anchoring the cantilever shelving to a vertical support may be adjustably moved to under support a shelf in a declining attitude or moved above the shelf to hang the same horizontally.

BRIEF SUMMARY OF THE INVENTION

The present invention is directed to an improved and simplified. adjustable cantilever shelf support assembly which obviates difficulties of presently known cantilever mounted shelf systems while readily affording selected horizontal or downwardly inclined shelf positions. In a presently preferred embodiment of this invention described hereinafter, a generally planar display shelf structure is fitted with a pair of rigid anchor brackets extending outwardly from rear corners of the shelf. Each bracket has a linear body secured at a selected acute angle to the plane of the shelf and is distinguished by a parallel offset upstanding peg formed at an operationally upper end thereof while its opposite or lower end has a co-planar rearwardly extending linear peg paralleling the plane of the shelf. A pair of vertical tubular supports are disposed for engagement by the anchor brackets; such supports having plural vertically aligned, non-uniformly spaced openings in front walls thereof for confronting the anchor brackets and receiving corresponding bracket pegs in selected of the openings to produce horizontal and downwardly inclined mounted shelf positions as selected.

It is a primary object of this invention to provide an improved, unitary, cantilever mounted shelf assembly which is capable of being selectively mounted to vertical supports in either horizontal or inclined shelf positions.

Another important object of this invention is to provide a operationally dependable and stable adjustable cantilever mounted shelf assembly particularly adapted for merchandise display.

Still another important object of this invention is to provide an adjustable cantilever mounted shelf and support assembly characterized by economies of manufacture, operational dependability and ease of assembly and use.

Having described this invention, the above and further objects, features and advantages thereof will appear from time-to-time from the following description of a preferred embodiment thereof, shown in the accompanying drawings and illustrating it's features; such embodiment representing the best mode presently contemplated for enabling those skilled in the art to make and practice this invention.

IN THE DRAWINGS

FIG. 3 is a right side elevational view of the assembly shown in FIG. 1 with the vertical support broken away in partial view and the shelf mounted in an inclined position;

FIG. 4 is a partial, broken away enlarged front elevational view with parts in section taken substantially along vantage line 4—4 of FIG. 3 and looking in the directions of the arrows thereon;

FIG. 5 is a broken away cross sectional view taken substantially along vantage line 5—5 of FIG. 4 and looking in the direction of the arrows thereon and indicating movement of the shelf structure from dotted line to full line positions in mounting the same in an inclined attitude on the vertical support;

FIG. 6 is a broken away side elevational view, similar to FIG. 3, showing the shelf assembly positioned in a horizontal position;

Figures 1, 2:
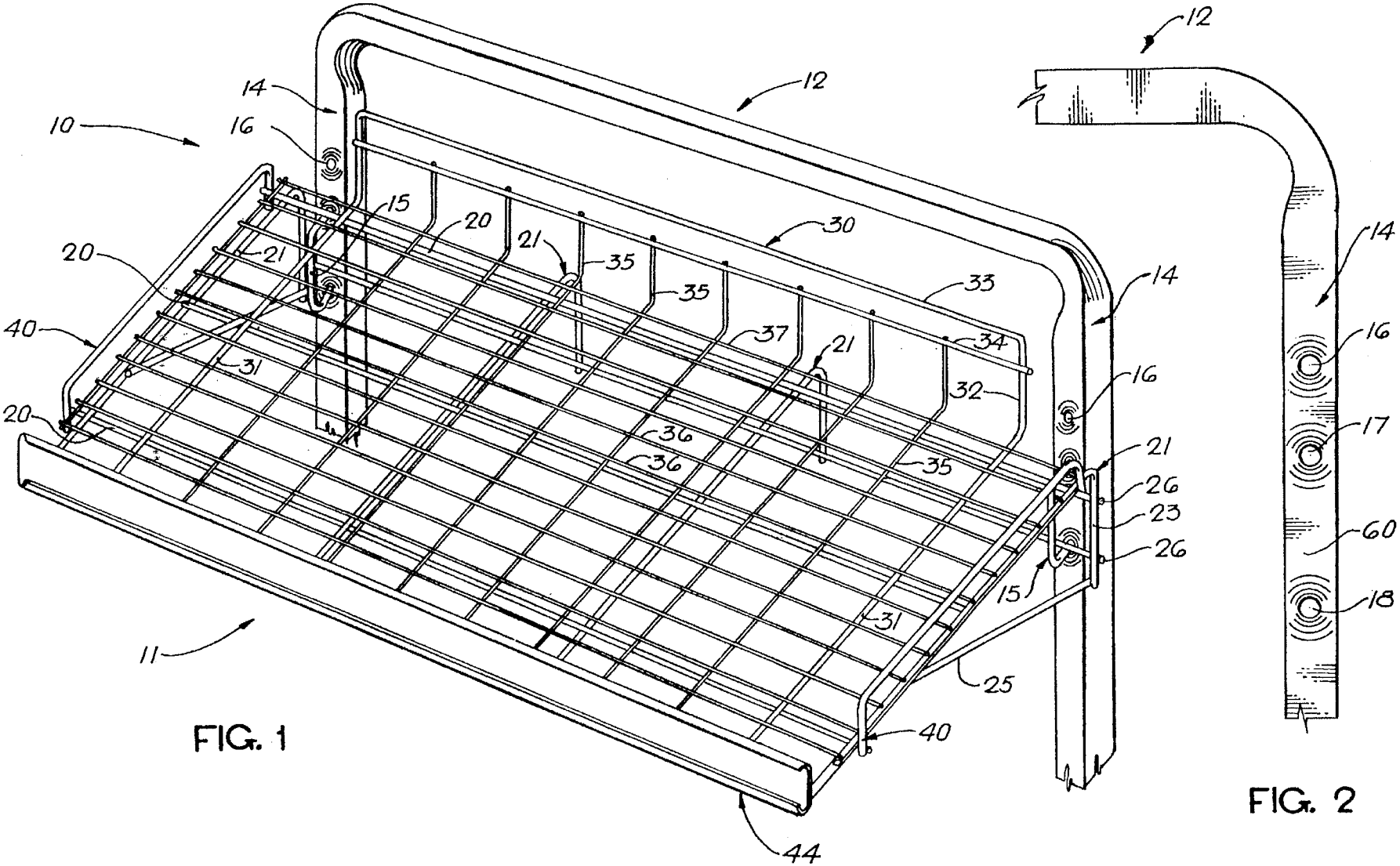
FIG. 1 is a broken away perspective view of a cantilever mounted shelf structure assembled in a downwardly inclined position on parallel vertical supports.
FIG. 2 is a partial, broken away enlarged front elevational view of the of a vertical support shown in FIG. 1.

FIG. 7 is a partial, enlarged broken away front elevational view, similar to FIG. 4, taken substantially along vantage line 7—7 of FIG. 6 and looking in the direction of the arrows thereon; and FIG. 8 is a broken away cross sectional view, similar to FIG. 5, taken substantially along vantage line 8—8 of FIG. 7 looking in the direction of the arrows thereon and indicating the movement of the shelf from a dotted to a full line position when mounting the same in a horizontal attitude on the vertical supports.

DESCRIPTION OF THE PREFERRED EMBODIMENT

With initial reference to FIG. 1 of the drawings an adjustable cantilever mounted shelf assembly hereof, indicated generally at 10, comprises a generally quadrangular planar shelf structure 11 shown mounted in a downwardly inclined position on a vertically upright, free standing, generally U-shaped tubular support frame 12, only partially shown in this figure. In this regard, it is to be noted that the free standing frame 12 may be replaced with a pair of laterally spaced, parallel, vertical support members fixed to a wall or other vertical supporting structure in accordance with conventional practice. The shelf 11 is interconnected with vertical tubular upright members 14 of the tubular frame 12 by means of a pair of laterally separated brackets 15 affixed adjacent to and extending from the rearward corners of the shelf 11, as will be explained in greater detail hereinafter; such brackets 15 being insertible into selected pairs of grouped circular openings 16, 17 and 18 formed in the vertical upright 14 as best seen in FIG. 2.

With reference to FIGS. 1–5 of the drawings, the particulars of the shelf 11 will now be described more fully. As there shown, shelf 11 comprises a generally quadrangular planar structure made up of interjoined cylindrical metal rods and wires interwelded to form an open grid rack particularly suitable for displaying merchandise M, such as newspapers, magazines or other articles (see FIG. 3).

In greater particular, the illustrated shelf structure 11 is made up of 3 linear, parallel spaced solid cylinder metal rods 20 which extend laterally of the shelf and define the width thereof. Four generally Z-shaped support rods 21 are disposed transversely across the underside of rods 20, one adjacent each of the outer lateral ends of rods 20 and two intermediate the ends thereof in generally evenly spaced parallel relation. Rods 20 and 21 typically are of like 0.375" diameter and are rigidly welded to one another to constitute the main frame for the shelf structure 11.

From FIG. 3 it will be noted that each of the Z-shaped rods 21 has an upturned short lip portion 22 at its outer end and a generally parallel downwardly turned longer leg portion 23 at the opposite or inner end thereof. The angular relationship between the leg portion 23 and main body 24 of each rod 21 is determined by the extent of depending or declining angle desired for the shelf when it is mounted in an inclined attitude as shown in FIGS. 1–5.

The main body 24 and the depending leg portion 23 of each of the Z-shaped rods at the lateral ends of the shelf are reinforced by a angle brace 25 welded at its ends to the body 24 and lower end of the leg 23 as best shown in FIG. 3. The several Z-shaped rods 21 are further interjoined by a pair of parallel spaced laterally extending rods 26, 26 (see FIG. 4) disposed at right angles to the depending leg portions 23 of the several Z-shaped rods and welded thereto.

In order to provide an undersupporting platform for the shelf, a generally U-shaped frame 30 is provided comprising elongated parallel legs 31 bent upwardly at one end to form arm portions 32 which are cross connected by a linear back rail 33. Frame 30 preferably is formed of substantially 0.125" diameter wire and has the arm portions 32 thereof stabilized at right angles to the back rail 33 by a cross connecting tie rod 34 welded at right angles to the arms 32 as best shown in FIG. 1. The legs 31 of the frame 30 are suitably welded at right angles to the underside of the laterally extending rods 20 along with a plurality of L-shaped lighter wire members 35 disposed in parallel spaced relationship across the width of the shelf. Members 35 are welded to the several rods 20 and to rod 34. A plurality of parallel spaced linear wires 36, 36 are welded at right angles across the upper side of frame arms 31 and the members 35 to extend across the width of the shelf parallel to the underlying support rods 20, thus providing a support bed for merchandise to be displayed thereon.

It will be understood that the upturned inner end portions of the several rods 35 welded to rod 34 in conjunction with back portion 33 of frame 30 form an upstanding wall defining a back support for the merchandise.

In a similar fashion the side margins of the shelf structure are defined by a pair of heavy metal rails 40, 40 welded to ends of the heavy frame members 20 at the lateral margins of the shelf to define side barriers for confining merchandise on the shelf. The front edge of the shelf is similarly closed by a label holding frame 44 welded to the upturned lip portions 22 of the Z-shaped members 21 (see FIGS. 3 and 6).

Although, the aforedescribed shelf structure in accordance with the herein disclosed embodiment of this invention is made as an open wire and rod network, it is to be understood that other suitable shelving structures may be employed as equivalents. It is to be appreciated, however, that the described and illustrated shelf structure hereof forms a rigid and sturdy support capable of accommodating relatively heavy loads such as magazines, newspapers or the like, as desired.

In order to complete the shelf structure and provide means for adjustably attaching the same to the vertical uprights of support frame 12 or wall mounted vertical rails, the aforementioned anchor brackets 15 are provided adjacent the two rearward corners of the described shelf assembly 11. For better understanding of the structure and operation of brackets 15 specific reference is now made to FIGS. 3–5 of the drawings.

As shown in FIGS. 3–5 of the drawings, each anchor bracket 15 is formed by bending a length of relatively heavy cylindrical metal rod, having a diameter of substantially 0.375" for example, to provide a linear body portion 50, bent at right angles near its upper end to form an offsetting neck portion 51. The neck portion in turn is bent upwardly at right angles adjacent its outer end to form an upstanding upper or top peg 52 having a free outer end aligned co-planar with, but laterally offset substantially parallel to body portion 50. The opposite or operationally lower end of body portion 50 is bent upwardly at a angle to extend rearwardly upward toward peg 52 whereby to provide a relatively longer lower peg 53. It is to be noted that the angle of bend between the peg 53 and the bracket body portion 50 is substantially equal to the bend angle between the body 24 and leg 23 of the Z-rods 21. Thus, the lower peg member 53 substantially parallels the plane of shelf structure 11 for reasons which shall appear presently (see FIG. 3).

To ensure rigid, dependable interconnection between the shelf and anchor brackets 15, the body portions 50 of said brackets are securely welded at right angles to the two parallel cross rods 26, 26 which extend between and are affixed at right angles to the several legs 23 of the Z-rods 21. Resultantly, the pegs 52 and 53 of the brackets 15 project rearwardly of the bracket legs 23 for entry into selected openings in the vertical upright member 14 (see FIG. 5).

Use and Operation

It will be recalled that the two upright member 14 of the free standing vertical support 12 shown in FIGS. 1 and 2 preferably are formed of rectangular tubing having planar front face walls 60 thereof provided with clusters of openings 16, 17 and 18 arranged at desired cluster intervals spaced along the vertical length of the upright member 14; such cluster intervals being determined by the desired spacing between superposed adjacent shelves to be carried by the upright members 14. It further will be noted that the spacing interval between the uppermost opening 16 and the intermediate opening 17 of each cluster of openings is materially shorter than the spacing interval between openings 17 and 18. In fact the spacing between openings 17 and 18 is selected to accommodate the spacing or distance between the two connective pegs 52 and 53 while the distance between openings 16 and 17 is substantially less than such distance between pegs 52 and 53 (see FIGS. 1 and 2). Because of this non-uniform spacing between adjacent peg receptive openings in the vertical support members, the shelf with its anchor brackets 15 presenting connective pegs fixed at prescribed distances is readily adapted to be supported in either inclined or horizontal operating positions as will appear presently.

In regard to such selected positioning of the shelf, reference to FIGS. 1 and 3–5 will illustrate that with the upper pegs 52 of the two brackets 15 inserted into the intermediate openings 17 of the vertical upright members 14, pivoting the shelf downwardly about peg 52 until the lower bracket pegs 53 enter the lower openings 18 as shown in FIG. 5, results in securing the shelf 11 in a downwardly inclined position as illustrated in FIG. 3, with rods 26 engaging the front faces 60 of the vertical uprights.

Conversely, as shown in FIGS. 6–8 of the drawings, when the upper pegs 52 are of the anchor brackets are inserted into the uppermost openings 16 of the vertical supports and the shelf is pivoted downwardly thereabout, as shown in FIG. 8, the outer ends of the lower pegs 53 abut faces 60 of the two vertical upright members 14 at positions between the openings 17 and 18 thereof. Consequently, shelf 11 is positioned substantially horizontally as shown in FIG. 6. This occurs because the angle between each anchor bracket body portion 50 and its lower peg 53 is equal to the angle between Z-rod portions 23 and 24 while the length of peg 53 is selected to engage the support wall 60 in generally co-planar alignment with the right angle bend between the offsetting bracket portion 51 and upper peg 52 or substantially so, (see FIG. 8). This geometrical relationship serves to align the plane of shelf 11 substantially horizontal in accordance with that objective.

From the foregoing it is believed that those familiar with the art will readily recognize and appreciate the novel advancement of the present invention over the prior art and although the invention hereof has been described and illustrated and associated with the preferred embodiment thereof, it will be appreciated that the same is subject to variation, modification and substitution of equivalents without departing from the spirit and scope of this invention which is intended to be unlimited by the foregoing except as may appear in the following appended claims.

The embodiments of the invention in which an exclusive property or privilege is claimed are defined as follows:

1. An adjustable, cantilever mounted shelf system, comprising:

a substantially quadrangular planar shelf, a pair of rigid anchor brackets fixedly secured to extend rearwardly outward of rear marginal corners of said shelf and in transverse relation to the plane thereof;

each said bracket having a linear body portion aligned at a selected acute angle to the plane of said shelf and formed with a generally parallel offset top peg at an upper end thereof and a lower peg extending angularly outwardly from a lower end thereof in generally parallel relation with the plane of said shelf; and a pair of a parallel, laterally spaced, vertically upright tubular support members presenting co-planar front walls having correspondingly arranged, vertically spaced openings therein receptively engageable with the bracket pegs, the spacing between vertically adjacent openings being non-uniform whereby insertion of the top pegs of said brackets into selected of said openings effects abutting engagement of the lower pegs of said brackets with said front walls to horizontally position said shelf while insertion of both the top and bottom pegs of said brackets into other of said openings effects inclined positioning of said shelf.

2. The shelf system of claim 1, wherein said brackets have the bodies thereof aligned at an angle to the plane of said shelf which determines the inclined position of said shelf.

3. The shelf system of claim 1 wherein the length of the lower pegs cooperates with said top pegs to horizontally position said shelf.

4. The shelf system of claim 1, wherein said openings in said front walls are arranged in vertically aligned three hole clusters located along the length of said support members at spaced intervals according to the desired spacing between superposed shelves.

5. The shelf system of claim 1, wherein said openings in said front walls are formed and arranged in clusters of three vertically spaced openings; the spacing between the uppermost and intermediate openings of each cluster being substantially less than the spacing between said intermediate and lowermost openings.

6. The shelf system of claims 5, wherein said top peg is offset from said body portion by an intervening neck portion extending at right angles to said body portion and said top peg and said spacing between said intermediate and lowermost openings equals the distance between said neck portion and said lower peg.

7. The shelf system of claim 6, wherein said body portion, neck portion, top peg and lower peg are integrally joined.

* * * * *